United States Patent [19]

Slay

[11] Patent Number: 5,065,983

[45] Date of Patent: Nov. 19, 1991

[54] HYDRAULIC POWER UNIT FOR JACK SYSTEM

[75] Inventor: Clyde E. Slay, Santa Ana, Calif.

[73] Assignee: Safe-T-Jack, Inc., Huntington Beach, Calif.

[21] Appl. No.: 504,552

[22] Filed: Apr. 3, 1990

[51] Int. Cl.[5] ..... B66F 3/24

[52] U.S. Cl. ..... 254/8 B

[58] Field of Search ..... 254/8 B, 2 B, 93 R, 254/93 H; 60/482; 91/400

[56] References Cited

U.S. PATENT DOCUMENTS

| | | | |
|---|---|---|---|
| 4,131,263 | 12/1978 | John | 254/8 B |
| 4,222,548 | 9/1980 | John | 254/8 B |
| 4,277,048 | 7/1981 | Okuda | 254/2 B |

*Primary Examiner*—Robert C. Watson

*Attorney, Agent, or Firm*—Gene W. Arant

[57] ABSTRACT

A hydraulic power unit for a two-part jack system, having lifting arms which are raised or extended by means of hydraulic power whenever an associated jack stand is to be either raised or extended. The necessary hydraulic pressure is generated manually, by use of a hand pump. The power unit includes a single release valve which operates automatically as an excess-pressure bleed-off valve whenever the hydraulic cylinder pressure exceeds design capacity, and is also adapted to be controlled manually from the handle of the power unit for unloading total hydraulic pressure whenever the lifting arms are to be lowered. The release valve and all of its associated mechanisms are mounted in or on a single metallic block which is very easily manufacturable.

3 Claims, 4 Drawing Sheets

HYDRAULIC POWER UNIT FOR JACK SYSTEM

RELATED APPLICATION

A related patent application assigned to the same assignee as the present application is "ALIGNMENT AND RELEASE MECHANISM FOR A TWO-PART JACK SYSTEM", Ser. No. 350,111 filed May 9, 1989 in which the present applicant is a co-inventor.

PRIOR ART

U.S. Pat. No. 4,462,569 shows a jacking system including a mechanical jack stand remotely controlled by a hydraulic power unit that is selectively attached to the jack stand. A MOBILE POWER UNIT FOR A JACKING SYSTEM is disclosed and claimed in U.S. Pat. No. 4,558,846. The Ritter U.S. Pat. No. 974,189 shows a manually controlled unloading valve in a hydraulically lifted chair. The following patents are believed to disclose the use of a single valve to automatically regulate high pressure and to manually release pressure in a hydraulic jack or the like: Dowty, U.S. Pat. No. 2,621,631; Quayle, U.S. Pat. No. 2,940,767; and Fujii, U.S. Pat. No. 3,740,952.

BACKGROUND OF THE INVENTION

The type of hydraulic power unit shown in the referenced patents has lifting arms which are raised or extended by means of hydraulic power whenever an associated jack stand is to be either raised or extended. The necessary hydraulic pressure is generated manually, by use of a hand pump. The power unit also includes a manually operated valve for dissipating the hydraulic pressure.

The above-referenced copending patent application Ser. No. 350,111 filed May 9, 1989 describes in some detail the mechanical and hydraulic steps that are taken in order to control an extendible jack stand from a separate hydraulic power unit. When a load is being lifted by the jack stand, if by chance the weight of that load exceeds the design capacity of the jack stand, then any excess fluid pressure is automatically relieved and the fluid returned to the fluid source. Thus, a valve with specifically designed release pressure is required to release that excess pressure. When the jack stand has been raised and the power unit is to be detached it is then necessary, by manual control, to unload the entire hydraulic pressure in order to lower the lifting arms. For this purpose an unloading valve is required.

Thus in a system of the foregoing type the control of the hydraulic pressure involves several separate and discrete steps.

During the raising or extension process the lifting arms of the power unit engage a load-supporting plate of the jack stand. Any hydraulic pressure developed in excess of design capacity is automatically released. When the jack stand has been raised or extended by a desired distance it then becomes locked in position by its own mechanism. Specifically, ratchet teeth carried by one telescoping member engage spring-loaded dogs carried by ratchet arms on another telescoping member. The hydraulic pressure utilized for powering the lifting arms may then be unloaded so that the lifting arms may be disengaged from the load-supporting plate of the jack stand and retracted.

Whenever the associated jack stand is to be lowered or retracted, the power unit is placed in alignment with it and hydraulic pressure is generated in order to raise or extend the lifting arms. The lifting arms engage the load-supporting plate of the jack stand in order to transfer its load from the ratchet teeth. The jack stand mechanism is then automatically retracted utilizing a mechanism of the type disclosed and claimed in U.S. Pat. No. 4,697,788. The hydraulic pressure in the power unit is then dissipated, preferably at a controlled rate in order to lower or retract the load at a controlled rate.

SUMMARY OF THE INVENTION

The present invention provides an improved hydraulic power unit for a jack system of the type referred to, in which the mechanism of the hydraulic circuit is greatly improved.

According to the invention a single release valve operates automatically as an excess-pressure bleed-off valve whenever the hydraulic cylinder pressure exceeds design capacity, and is also adapted to be controlled manually from the handle of the power unit for unloading total hydraulic pressure whenever the lifting arms are to be lowered.

Also in accordance with the invention the release valve and all of its associated mechanisms are mounted in or on a single metallic block which is very easily manufacturable.

Among the advantages of the invention are reduced cost of manufacturing, and greater ease and convenience of repair of the equipment if such should become necessary.

Thus the object and purpose of the invention is to provide an improved hydraulic power unit for a jack system.

DRAWING SUMMARY

DETAILED DESCRIPTION

Figure 1:
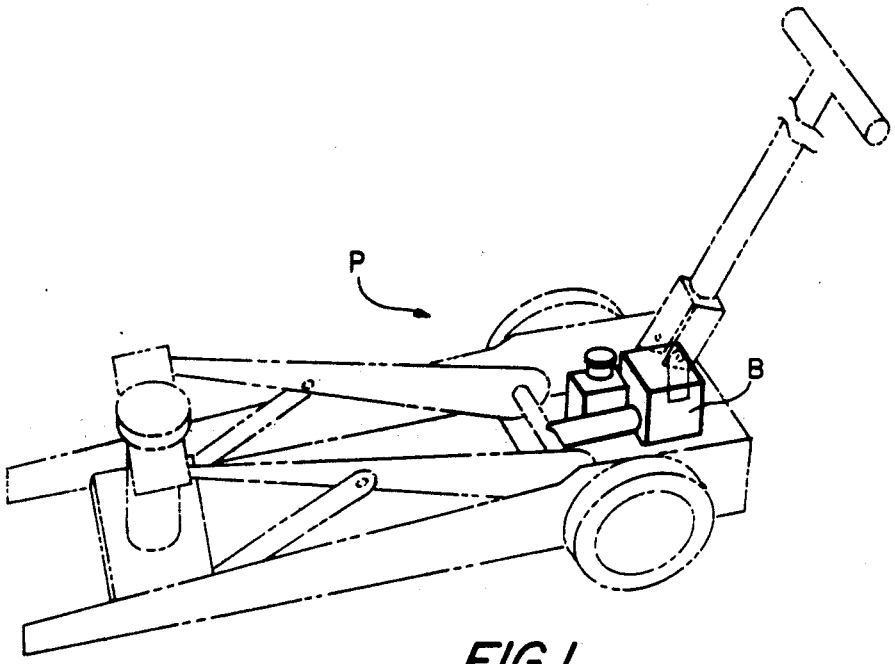
FIG. 1 is a perspective view of a hydraulic power unit for a jack system in accordance with the invention.
Figure 5:
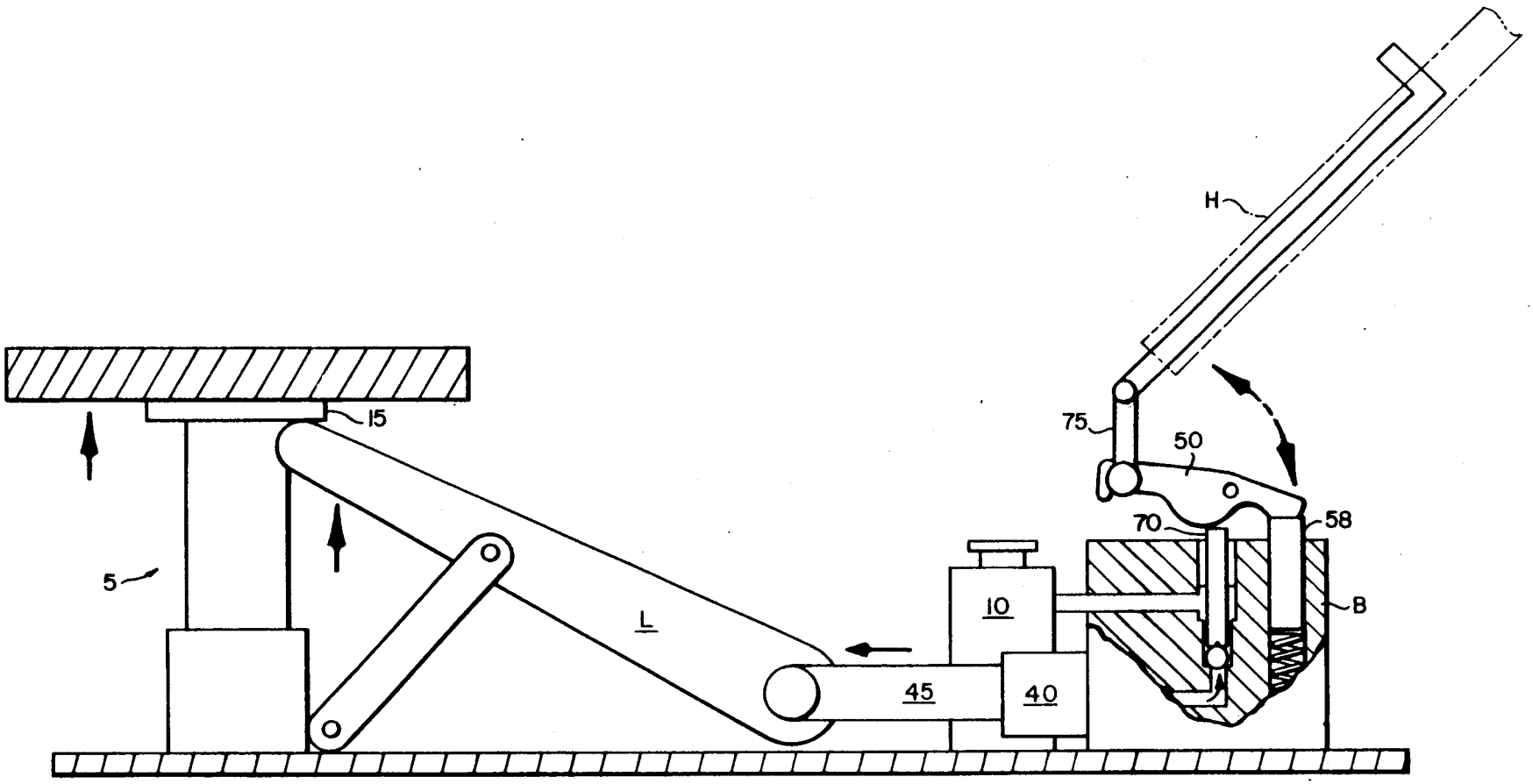
FIG. 5 is a side elevation view, partially in cross-section, of the power unit during actual usage for lifting a loaded jack stand.

Referring now to the drawings, FIG. 1 is a perspective view showing in dotted lines the general form of a power unit which incorporates the present invention, the novel release valve assembly being shown in solid lines. Referring in particular to FIG. 5 of the drawings, the hand-operated hydraulic power unit P for a jack system is shown in a largely schematic form, together with a jack stand S that is being raised by the power unit. Power unit P includes a handle H which is shown only in dotted lines. Beneath the handle H is a block B containing hydraulic circuitry. A fluid reservoir 10 is located forwardly of block B, and a hydraulic cylinder 40 is located adjacent to block B on the near side of the reservoir. A ram 45 extending forward from cylinder 40 drives a pair of pivotally supported lifting arms L, which in turn lift a load-bearing plate 15 of jack stand S.

Figure 4:
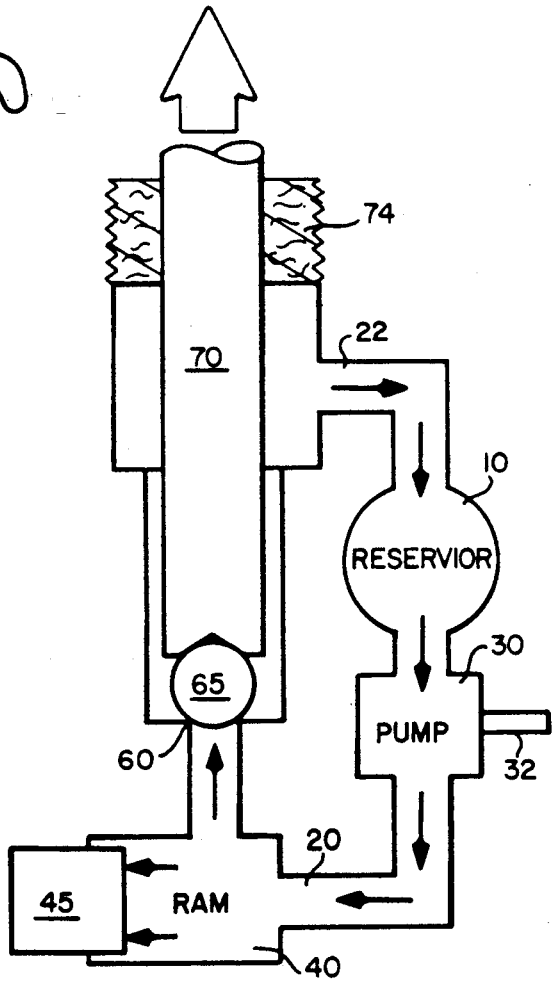
FIG. 4 is a schematic diagram of the hydraulic circuit of the hydraulic power unit.

Reference is now made of FIG. 4 which schematically illustrates the complete hydraulic circuit. A hydraulic fluid reservoir 10 is included in a closed-loop flow path 20 for fluid to flow out of, and then back into, the reservoir. Fluid is drawn from the reservoir by a manually operated pump 30 which forces fluid out of the reservoir and along the flow path 20. A pair of one-way valves, not specifically shown, are preferably included on the input and output sides of the pump. The hydraulic cylinder 40 has one of its ends in communication with the flow path 20. The hydraulic ram 45 in the other end of the hydraulic cylinder is drivingly coupled to the lifting arms (shown in FIGS. 5 and 6 but not in FIG. 4).

The flow path 20 has a valve seat 60 formed therein. A ball valve member 65 is normally seated upon the valve seat 60 and engages one end of an actuating rod 70. That end of the actuating rod is housed partially within the flow path, seated upon the ball valve 65. When hydraulic pressure within the cylinder 40 and acting against the valve member 65 is sufficient it will lift the valve member 65 off its seat 60 and permit fluid to flow through the path section 22 back into the reservoir.

Figure 3:
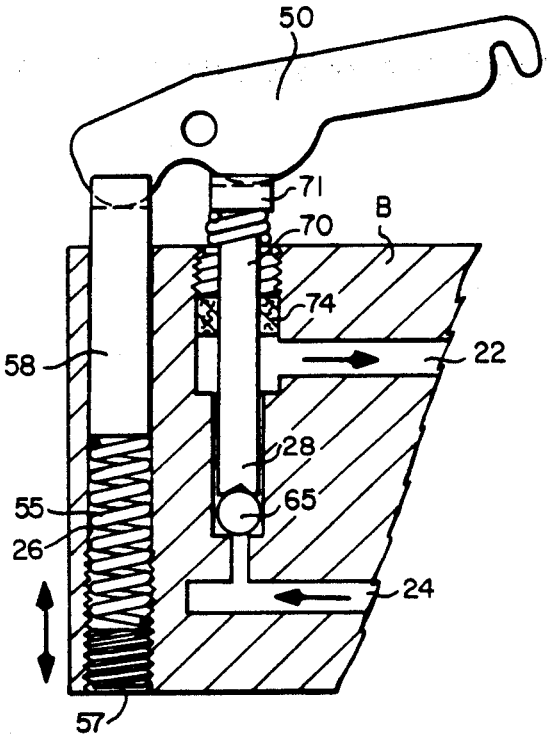
FIG. 3 is a vertical cross-sectional view of the release valve and lever housing in its assembled and operational condition.

FIG. 3 shows in cross-section the structure of a release valve assembly in accordance with the present invention, including a portion of the hydraulic circuit outlined in FIG. 4. A solid metal block B has passageways 22, 24, 26, and 28 cut therein. Each of passageways 22, 24, and 26 is a straight cylindrical passageway. Passageway 28 is also a straight passageway but consists of three sections of differing cylindrical diameters, the deepest end of that passageway having the smallest diameter and intersecting the end of passageway 24. Passageway 22 intersects passageway 28 near the bottom of its first and widest section. Passageways 26 and 28 are parallel to each other. Passageways 24, 28, and 22 collectively provide a return path for coupling hydraulic pressure from hydraulic cylinder 40 to reservoir 10.

A pressure release lever 50 is pivotally mounted on block B on its upper surface. A compression spring 55 is disposed within the lower portion of passageway 26 whose threaded lowermost end is closed by an adjusting nut 57. A shaft 58 occupies the upper portion of passageway 26 and couples spring 55 to release lever 50 on one side of its pivotal support, for driving it in one direction of pivotal movement.

An actuating rod 70 is disposed within the upper end portion of passageway 26 and couples ball valve member 65 to the release lever 50 on the other side of its pivotal support, for driving it in the other direction of pivotal movement. The strength of the spring 55 is selected to bias the release lever 50 so as to retain valve member 65 on valve seat 60 against a predetermined level of fluid pressure, so that any excess pressure will lift the ball valve member from its seat and thus automatically permit fluid to escape back to the reservoir.

An outer extremity of release lever 50 is equipped with a hook which is in turn connected to a rod 75 that is operated from handle H, see FIG. 5. An upward pull on rod 75 (FIG. 5) causes the release lever to relieve its normal pressure (caused by spring 55) upon actuating rod 70 and hence upon ball valve 65. Pressure in flow path 20 therefore lifts the valve from its seat, and fluid escapes along flow path 20 back to reservoir 10. Rod 75 is used whenever it is desired to unload all hydraulic pressure from cylinder 40.

Actuating rod 70 has an enlarged head 71 and passes through a central opening in a nut 72 which closes the threaded upper end of passageway 28. A packing ring 74 surrounds rod 70 below nut 72. A spring 76 located between the head of rod 70 and nut 72 prevents rod 70 from becoming stuck in position because of friction with the packing ring 74.

Figure 2:
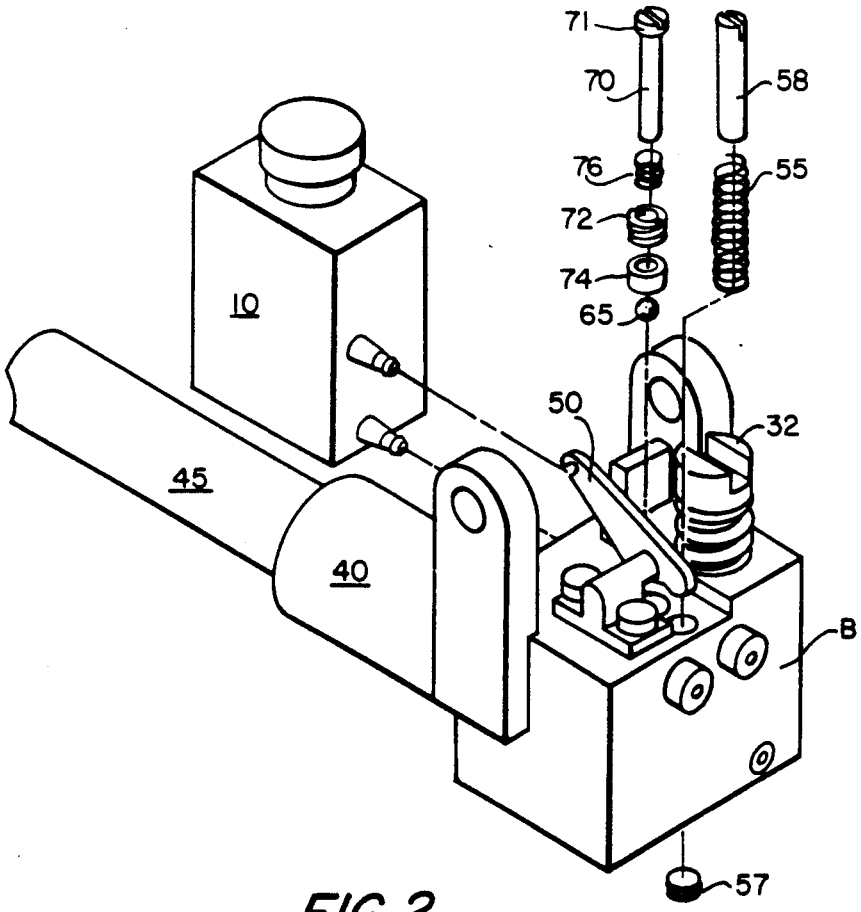
FIG. 2 is an exploded perspective view of a release valve and lever apparatus in accordance with the invention.

FIG. 2 shows an exploded perspective view of the release valve assembly, including a pump plunger 32 which is reciprocatingly driven by handle H. See FIG. 5.

Figure 6:
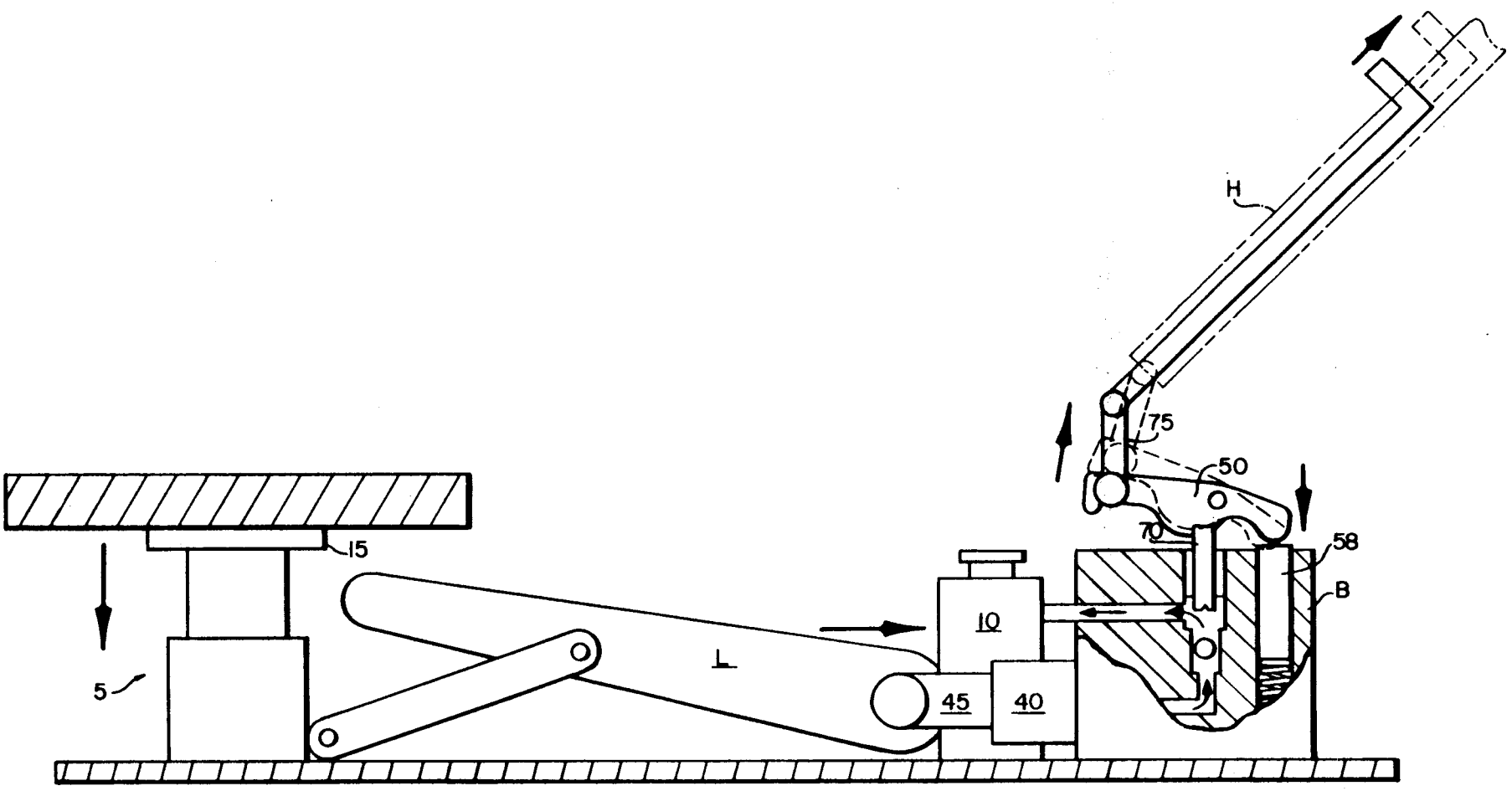
FIG. 6 is a view like FIG. 5 but showing the operation when the jack stand is being lowered.

FIG. 6 shows the operation when rod 75 is actuated for releasing all fluid pressure in cylinder 40.

The invention has been described in considerable detail in order to comply with the patent laws. However, the scope of the invention is to be measured only in accordance with the appended claims.

What I claim is:

1. A hand-operated hydraulic power unit for a jack system comprising, in combination:

(a) hydraulic fluid reservoir means;

(b) means defining a flow path for fluid to flow out of, and then back into, said reservoir means;

(c) manually operated pump means for forcing fluid out of said reservoir means along said flow path;

(d) a hydraulic cylinder having one end thereof in communication with said flow path;

(e) a hydraulic ram in the other end of said hydraulic cylinder for lifting a pair of pivotally mounted lifting arms;

(f) a pivotally supported pressure release lever;

(g) resilient means engaging said release lever on one side of its pivotal support for forcing said lever to rotate in one direction relative to its pivotal support;

(h) said flow path having an outlet port forming a valve seat therein;

(i) a ball valve member normally seated upon said valve seat;

(j) actuating rod means housed partially within said flow path, seated upon said valve member and engaging said release lever on the other side of its pivotal support for forcing said lever to rotate in the other direction relative to its pivotal support;

(k) said means defining a flow path including a metal block having a series of interconnected straight passageways formed therein, said outlet port and valve seat being formed by one end of one of said passageways, and the other end of said one passageway extending beyond said flow path and housing said actuating rod means; and (l) manual means for selectively rotating said release lever in said other direction of rotation;

whereby when said pump means is operated for forcing fluid to flow from said reservoir means into said flow path it builds up fluid pressure against said valve member, then whenever the pressure against said valve member exceeds a predetermined level it is applied by said actuating rod means to said pressure release lever so as to overcome said resilient means and thereby cause said lever to move, so that excess pressure escapes past said valve member along said flow path and back into said reservoir means; and whereby when it is desired to unload the pressure against said hydraulic ram said manual means is operated so as to permit said valve member to be raised from its seat and the entire fluid pressure in said cylinder to be bled off to said reservoir means.

2. In a hydraulic power unit for a jack system, the combination comprising:

means providing a closed-loop hydraulic circuit including a reservoir, a hand-operated pump, a cylinder having a ram therein, and a return path for fluid to flow from said cylinder back to said reservoir;

a metal block having a plurality of passageways formed therein which collectively provide said return path, all of said passageways being straight cylindrical passageways;

a valve seat formed in one of said passageways;

a ball valve member on said seat, adapted to receive pressure from the cylinder and when lifted from said seat to allow fluid to flow from the cylinder to the reservoir;

a pressure release lever pivotally mounted on said block;

an actuating rod disposed within said one passageway and coupling said valve member to said release lever on one side of its pivotal support;

spring means housed within another passageway within said block and coupled to said release lever on the other side of its pivotal support, said spring means biasing said release lever to retain a predetermined level of fluid pressure against said valve member;

said means providing a closed-loop hydraulic circuit including two additional passageways in said block which intersect said one passageway on respectively opposite sides of said valve seat; and means for manually actuating said release lever.

3. In a hydraulic power unit for a jack system having means providing a closed-loop hydraulic circuit including a reservoir, a hand-operated pump, a cylinder having a ram therein, and a return path for fluid to flow from said cylinder back to said reservoir, the improvement comprising:

a metal block having a plurality of straight cylindrical passageways formed therein, one of said passageways having three sequential selections of successively smaller diameters, the end face of the next-to-last such section forming a valve seat;

another passageway intersecting the smallest section of said one passageway in substantially perpendicular relation thereto;

a third passageway intersecting the largest section of said one passageway adjacent the next-largest section thereof in substantially perpendicular relation thereto;

a ball valve resting on said valve seat;

an actuating rod engaging said ball valve and extending through said largest section of said one passageway and external to said block;

packing means surrounding said actuating rod and occupying said largest section of said one passageway;

a release lever pivotally mounted external to said metal block and engaged by said actuating rod on one side of its pivotal support;

a shaft having one of its ends engaging said release lever on the other side of its pivotal support;

a fourth passageway in said metal block which slidably receives said shaft; and spring means housed within said fourth passageway in engagement with the other end of said shaft and urging said release lever toward pivotal movement.

* * * * *